United States Patent [19]

Fair

[11] Patent Number: 4,821,339

[45] Date of Patent: Apr. 18, 1989

[54] PROTECTIVE VEST HAVING A CERVICAL COLLAR

[76] Inventor: Jeffrey D. Fair, 4801 N. Britton, Stillwater, Okla. 74075

[21] Appl. No.: 65,859

[22] Filed: Jun. 23, 1987

[51] Int. Cl.[4] ..... A41D 13/00

[52] U.S. Cl. ..... 2/2; 2/44; 2/102

[58] Field of Search ..... 2/2, 44, 102

[56] References Cited

U.S. PATENT DOCUMENTS

| | | | |
|---|---|---|---|
| 3,189,917 | 6/1987 | Sims | 2/2 X |
| 3,497,872 | 3/1970 | Mitchell | 2/2 |
| 3,514,784 | 6/1970 | McDavid | 2/2 |
| 3,855,631 | 12/1974 | Ettinger | 2/2 |
| 4,094,015 | 6/1978 | Howard | 2/415 |
| 4,219,193 | 8/1980 | Newman | 2/411 X |
| 4,338,685 | 7/1982 | LaPorta, Jr. | 2/2 |
| 4,501,023 | 2/1985 | Bilberry | 2/44 X |
| 4,590,622 | 5/1986 | Wolfe et al. | 2/2 |

OTHER PUBLICATIONS

Promotional Material: "Pro-Roll", Diversified Medical Products, Inc. (undated).

*Primary Examiner*—Louis K. Rimrodt

*Attorney, Agent, or Firm*—Fitch, Even, Tabin & Flannery

[57] ABSTRACT

Disclosed is a protective vest having a collar or neck guard intended for use with helmets and, optionally, with shoulder pads or harnesses, of the types worn by players in contact sports. The protective vest has a flexible body with shoulder portions between chest and back panels. Surrounding an opening for receiving a player's neck is a raised collar, integrally formed with the body, which has an upper ring-like surface for contacting the bottom edge of the player's helmet. When contacted by the player's helmet, the collar, formed of resilient material, is placed in energy-absorbing compression. Also, the chest and back panels surrounding the collar, also being made of resilient material, are placed in a tension and compression loading, to further aid in absorbing the loading applied to the collar. The body portion and, particularly, the chest and neck panels are pliable so as to conform to the topography of the player's upper torso and to frictionally engage the player's body and any clothing in contact with the player's body underneath the protective vest, so as to provide the frictional engagement necessary for efficient energy absorption.

13 Claims, 1 Drawing Sheet

PROTECTIVE VEST HAVING A CERVICAL COLLAR

BACKGROUND OF THE INVENTION

1. Field of the Invention

The present invention pertains to protective athletic equipment, particularly equipment for reducing or eliminating neck injuries.

2. Description of the Prior Art

Over the years, there have been significant improvements in protective equipment of the type worn by athletes, particularly athletes engaged in contact sports. Helmets, for example, have undergone considerable improvements in preventing the risk of concussion or bruising of the various portions of the top, sides and back of an athlete's head. Face guards and face shields have been added to reduce or prevent the risk of injury to a wearer's nose and face. U.S. Pat. No. 4,094,015, for example, shows yet another type of protective feature, that of a neck roll attached to the bottom of the helmet. The neck roll, made of cushion material, provides a cushioning effect when contacting the shoulders of a wearer, preventing damage when the wearer's head is rotated, hyperextended, or hyperflexed. However, since the neck roll is attached to the helmet, it does not cooperate with shoulder pads or the like shoulder-protecting arrangements to protect the wearer from risk of injury caused by a sideways displacement of the shoulder pads which presses the shoulder pads together, reducing the size of the neck opening. Also, during a whiplash-like excursion of the neck, for example, the neck roll can slide against the shoulder pads, thereby reducing the amount of energy it can absorb. Also, the neck roll fails to provide protection for other parts of the wearer's body, such as the shoulders, chest or upper back.

Cervical collars and the like devices have been developed exclusively to prevent the risk of injury to a player's neck, particularly when the player's head is twisted, rotated, and/or pushed upwardly toward the center of a player's torso. Hyperextension, rotational hyperextension, and whiplash are some of the more common types of injuries sustained by a player's neck when the head is deflected an unusual amount. U.S. Pat. No. 4,219,193 discloses a spring frame anchored to a player's shoulders which extends upward behind the rear of a player's helmet to alleviate these types of injuries. The spring framework, however, also resists a "normal" range of motion of a player's head, that which is usually not associated with injury caused by an unusual excursion of the neck. The spring framework is therefore not well-suited to competitive sports, in that it necessarily restricts the freedom of movement, and also since it has protrusions and surface irregularities which may be grasped or may become caught or snagged during the playing of a contact sport such as football.

U.S. Pat. No. 3,189,917 provides a neck collar designed to encircle the neck of a player, so as to be positioned between the bottom of the player's helmet and the player's shoulder pad. Since the protective collar is relatively small and lightweight, and is not secured to a larger, more massive piece of equipment such as the shoulder pads, it can easily become dislodged or dislocated. Further, as with the other devices mentioned above, the neck collar of the '917 patent is relatively inefficient in dissipating potentially injurious forces, and does not, for example, transmit those forces to a player's chest and upper back portions.

U.S. Pat. No. 3,514,784 discloses protective football apparatus mounted to or incorporated in the shoulder pads, having a rigid collar portion or guard to protect the player's neck. The guard is described as being made from a plastic or lightweight metal to prevent whiplash injury upon extreme rearward deflection of a player's head. While generally adequate in preventing contact and bruising type injuries associated with contact to the wearer's neck, the rigid neck guard does not offer a resilient absorption of neck-distorting forces experienced by deflection of a player's head. Further, the neck guard must be secured to the shoulder harness or shoulder pads at several points, and, in general, must be formed or at least adjusted for particular anatomical and shoulder pad configurations to provide the close fit needed for adequate protection. Further, although formed of lightweight material, the neck guard, which extends to cover the player's chest, is relatively massive and may tend to restrict some ranges of motion as the player moves during an athletic event.

U.S. Pat. No. 4,338,685 provides a cervical collar with chest and back plates which are secured to the player's shoulder harness at several points. The majority of the collar is generally rigid and inflexible, so as to transmit unusual distortions of a player's head and neck as cantilever forces which are applied to the player's chest and upper back. The rigid collar construction increases the weight of the player's equipment, while restricting the player's mobility. This is also true of the plates which encase or enclose major portions of the player's chest and back, to which the rigid collar members are riveted or otherwise securely fastened. A cushioning ring-like pad attached to the chest and back plates surrounds an opening which receives the player's neck. Proper alignment of the cushioning ring-like pad or collar surrounding the neck opening may be lost when the player's shoulder harness or shoulder pads are deflected either by an edge-wise, or upwardly-directed force, tending to dislodge or otherwise dislocate the shoulder harness. Further, to provide a close fit needed to reduce the effect of dislodging forces, the cervical collar construction must be configured for a particular player's anatomy and shoulder pad configuration.

SUMMARY OF THE INVENTION

In general, it is desirable to provide a protective cervical device which conforms closely to a particular player's anatomy, while being formed separately and independently of a helmet, shoulder pads, or other equipment that may be worn by the player, and such is an object of the present invention.

Another object of the present invention is to provide a device for protecting a player's neck without adding significantly to the weight that a player must carry, and without significantly restricting the ranges of motion of various parts of the player's upper torso, including the player's shoulders and arms, as well as the player's head and neck.

Yet another object of the present invention is to provide a protective device which safely absorbs and dissipates forces applied to a player's head.

Still another object of the present invention is to provide a device for protecting a player's neck in which any distortion or dislodging forces to the protective device are resiliently resisted with bias forces which increase with the force applied and which quickly restore the device to its proper position, should minor distortions be experienced.

These and other objects of the present invention which will become apparent from studying the appended claims and description are provided in a protective device for use with helmets of the type worn by players in contact sports. The protective device consists of a flexible body having shoulder, chest and back portions covering substantial portions of the shoulders, chest and back of a player respectively, and having a raised resilient collar immediately adjacent a central portion of the device defining an opening for the head of a wearer of the device. The raised resilient collar is joined to the chest and back portions so as to transmit thereto forces applied to an upper surface of the raised collar by the back and side portions of a bottom of a helmet worn by the wearer. The flexible body has inner and outer surfaces for frictionally engaging at least one of the clothing, equipment and body of a wearer so as to maintain the device in a preselected position about the body of a wearer.

BRIEF DESCRIPTION OF THE DRAWINGS

In the drawings, wherein like elements are referenced alike.

DETAILED DESCRIPTION OF THE PREFERRED EMBODIMENT

Figure 1:
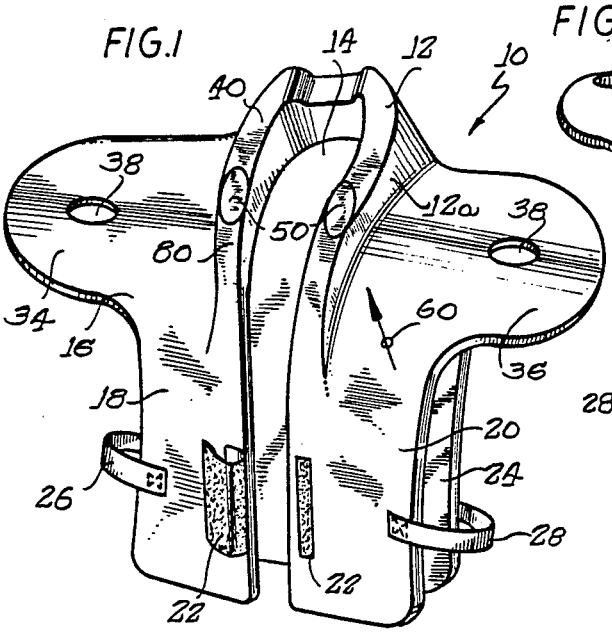
FIG. 1 is a perspective view of a protective vest with neck guard, illustrating aspects of the present invention.

Referring now to the drawings, a protective device indicated generally at 10 is adapted to be worn about the shoulders, chest and back of a player. According to one aspect of the present invention, the protective device 10 is vest-like in construction and is formed of a resilient, pliable material such as closed-cell foam, preferably a cross-linked, closed cell foam. The device 10 includes a raised, resilient collar 12 surrounding an opening 14 for receiving the player's neck. Preferably, collar 12 is formed as part of a unitary construction, along with flexible vest-like body 16 of device 10, to achieve advantages according to other aspects of the present invention, which will be explained hereinafter. Collar 12 may, however, be separately formed and attached to body 16 using a suitable adhesive. In addition to collar 12, body 16 includes a pair of opposed chest panels 18, 20 which are releasably separated from one another by hook-and-loop fastener material 22 to allow easy fitting about the body of a wearer. Opposite the chest panels 18, 20 is a unitary back panel 24. Optional straps 26, 28 connect the lateral edges of back panel 24 to the lateral edges of respective chest panels 18, 20 by encircling the player's rib cage. Intermediate the back panel 24 and chest panels 18, 20 are shoulder portions 34, 36, which include apertures 38 to provide clearance for the protruding bone at the top of the player's shoulder.

Figure 3:
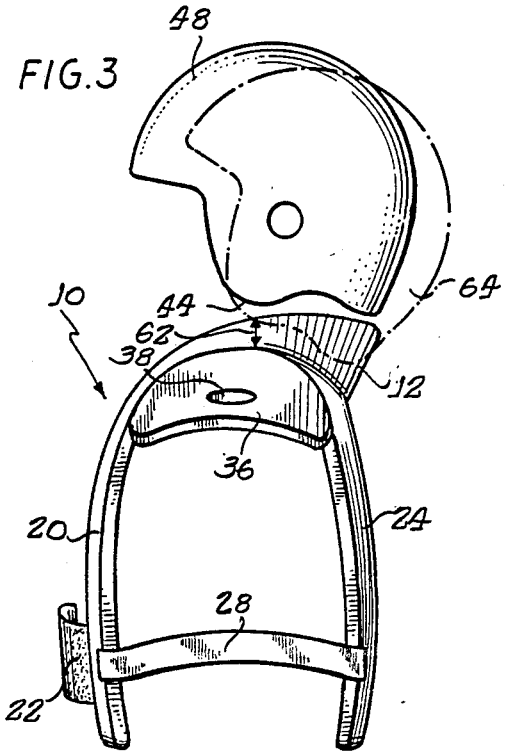
FIG. 3 is a lateral view of the protective device of FIG. 1 shown in conjunction with a protective helmet as worn by the same player.
Figure 4:
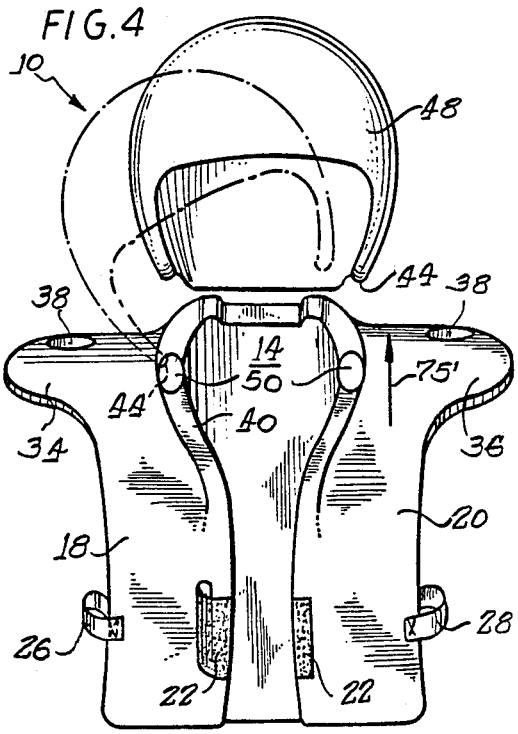
FIG. 4 is a front elevational view of the helmet and protective device of FIG. 3.

The raised collar 12 has a relatively flat ring-like upper surface 40 for contacting the bottom edge 44 of a player's helmet 48, as illustrated in FIGS. 3 and 4. As indicated in phantom in FIGS. 3 and 4, when helmet 48 is rotated, a lower protruding part 44 thereof contacts the upper surface 40. In order to prevent accelerated wear of collar 12 caused by repeated rolling and sliding contact with the downward protrusions 44 of helmet 48, a pair of disk-like protector pads 50 made of plastic or other abrasion-resistant material are attached to the upper surface 40, preferably by adhesive. As indicated in the figures, disk-like protector pads 50 are relatively small in size, and in one embodiment are no more than 2" in their largest extent.

The upper ring-like surface of collar 12 is, according to one aspect of the present invention, of a substantial thickness or width ranging between approximately 1" and $1\frac{3}{4}$" wide to ensure contact with the bottom of the player's helmet at all times, while avoiding an unduly bulky and restrictive impediment to the player's range of motion. Collar 12 extends upwardly, toward a player's helmet, such that the top surface 40 thereof is closely spaced to the helmet bottom edge. For example, in one exemplar embodiment of the present invention, the collar has a height 62 (see FIG. 3) ranging between 2" and $2\frac{1}{2}$" so as to bring the upper edge 40 thereof at least level with and preferably extending above a shoulder harness or shoulder pads that may be worn by the player. FIG. 3 illustrates an optional "low profile" collar having a lower rear portion, to provide a greater unrestricted range of motion. However, if a greater protection against whiplash and the like extreme excursion of the neck is desired, collar 12 may be raised, so as to have an upper rear surface which is very closely spaced to the bottom rear edge of the player's helmet when the player's head is in a generally upright or slightly forwardly inclined position.

According to one aspect of the present invention, the raised collar 12 extends into the neck opening of any shoulder harness or shoulder pads a player might be wearing. In this arrangement, the side surface 12*a* of the collar is in contact with the inside edge of the shoulder pads, with the lateral thickness of the raised collar 12 being constantly positioned between the shoulder harness and the player's neck. This prevents risk of injury, particularly a bruising or pinching injury to the neck caused when the player's shoulder pads are compressed together, reducing the neck-receiving opening between the shoulder pads. With the raised collar 12 of the present invention, a substantial thickness of foam material is constantly provided to reduce risk of this type of injury, and to provide other advantages.

Figure 5:
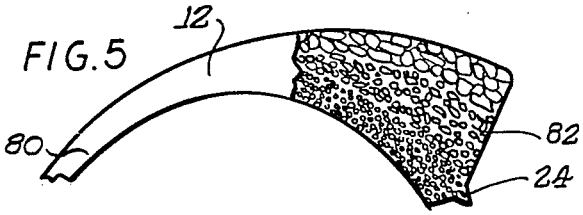
FIG. 5 is a fragmentary view, shown partially broken away, taken along the lines of 5—5 of FIGS. 2 and 4.

Referring now to FIG. 5, further aspects and advantages of the present invention will be described with reference to a fragmentary, partially cut-away portion of collar 12, that generally taken in the direction of arrows 5—5 of FIGS. 2 and 4. The collar 12, as indicated in FIG. 5 has a forward portion 80 adjacent chest panel 18, and a rearward portion 82 adjacent back panel 24. As indicated in FIG. 5, collar 12 may be constructed of multiple discrete layers of varying density of closed-cell foam material. It is preferred, however, that collar 12 be formed of unitary construction, with the layers of varying density being formed in the process of fabricating the body 16. For example, the outermost or upper layers of collar 12 can have closed-cell foam which is less dense than that adjacent the shoulders of a player's body, to provide a range of control over the resilient compression which dissipates deflecting forces applied by the player's helmet. The density of foam in the collar and the grading of that density from top to bottom in the collar and from point to point about the circumference of the collar can be altered to provide a balance between the amount of energy which can be absorbed and the freedom of movement to the player's head and neck.

One important aspect of the present invention is the ability of device 10 to resist dislocation when forceful contact therewith is made during the course of an athletic event. Device 10 is intended to be worn underneath the shoulder harness or shoulder pads in contact with the player's body which, for the purpose of explaining aspects of the invention, means either contact with relatively tight-fitting clothing or direct contact with the player's anatomy. According to one aspect of the present invention, the body 16 of device 10 is made of a resilient material such as cross-linked, closed-cell foam, which is sufficiently supple or pliable so as to generally conform to the topographical features of a player's anatomy in static, flexed, and moving conditions as would occur during the course of an athletic contest. This allows an intimate engagement with the player's upper torso (or clothing worn about the upper torso) over a majority of the upper torso surface area. Preferably, the pliable, resilient material of body 16 has a significant coefficient of friction which, in conjunction with the large area of engagement, covering the chest and back of a player, provides very substantial frictional forces which resist applied forces tending to dislodge or dislocate device 10.

For example, device 10 satisfactorily resists forces applied thereto in the direction of arrow 60, as when a football player wearing the device is tackled or blocked. Rather than cause a displacement of the vest-like body 16, the stresses applied thereto cause a local stretching in the area of arrow 60, which in turn increases the frictional engaging forces developed over the relatively large areas of chest panel 20. Further, when strap 28 is employed, these forces will also be transmitted through the strap to the back panel 24, which has an even greater area of engagement with the player's body. It can now be appreciated that the ability of body 16 to conform to the surface topography of a player's anatomy provides an important significant frictional engagement. Further, due to the resilient nature of the material from which body 16 is formed, the greatly enhanced frictional engagement, or anchoring, of the body to a player transforms the dislodging force into a deforming force, which not only enhances the frictional engagement, but also applies those forces to stretch local areas of significant size, so as to very effectively absorb and dissipate the applied forces. Due to the inherent resilience of the material from which body 16 is formed, energy absorption increases as the applied forces increase. The large area, supple panels of body 16 very closely follow the complex and rapid movements of a player's body, maintaining the desired engagement necessary for effective energy absorption throughout the player's range of motion. Thus, it can be seen that the raised collar portion 12 is maintained in its desired position to an extent heretofore unrealized with prior art protective equipment.

As is made apparent from the above, an important aspect of the present invention is the ability of device 10 to be placed in tension, so as to absorb portions of the loading applied to the collar. It is important that the body 16 have relatively large areas engaging the body and/or clothing of a player and that it remain in frictional engagement during times of loading, for example, when the player is being blocked or tackled. Accordingly, it is contemplated that device 10 be worn under a relatively close-fitting outer garment, particularly if the straps 26, 28 are omitted. For example, if device 10 is worn under a relatively close-fitting jersey, the chest panels 18,20 and back panel 24 will remain in engagement with (i.e., pressed against) the player's upper torso, thereby providing the frictional engagement needed for effective load absorption. The releasable hook-and-loop fastener material 22 holding chest panels 18, 20 together, also serves an important function in this regard.

If, however, the player is not wearing a close-fitting outer garment, or if even greater frictional engagement is desired, the girdling-type straps 26, 28 can provide even greater engagement with the player's upper torso. While straps 26, 28 are illustrated as being relatively narrow in width, other arrangements are possible. For example, straps 26, 28 can be replaced with a soft, resilient netting spanning any desired portion of the vertical height of the chest and back panels. Alternatively, the foam material can be extended on the lateral sides of the player's rib cage and secured to the chest panels with hook-and-loop fastener material, if greater protection of the player's rib cage is desired. In this connection, it will now be appreciated that body 16, when formed of a resilient material such as foam, also provides a padding protection of the player's upper torso, including, most importantly, the kidneys, rib cage, collarbone and shoulders of the player, areas in which greater protection is frequently desired and often needed. If desired, the back or chest panels, or the shoulder portion of body 16, can be made from a thicker or more resilient foam material to provide any added padding required. Foam material is especially advantageous in this regard since a blow to some portion of the foam material usually results not only in a compression of that area, but in a tension and stretching of the surrounding area. If, however, additional padding is not required and optimal freedom of movement is desired, body 16 can be formed from a cross-linked, closed-cell foam of thickness ranging between approximately $\frac{1}{4}''$ and approximately $\frac{3}{8}''$ in thickness.

According to one aspect of the present invention, the material of body 16 is chosen to effectively transmit forces applied to the upper surface of the collar, not only to the energy-absorbing mass of the collar but also into the back and chest panel portions of the device, so as to provide further advantages when stressed by excursion of the player's head and helmet. For example, when helmet 48 is rotated to the side and rear of the player's body, as illustrated in phantom in FIG. 4, compressive forces applied to the upper surface 40 of collar 12 are not only resiliently absorbed in collar 12, but are also transmitted therethrough into the back and chest panel portions of body 16. For example, part of the force applied to collar 12 is directed in line with arrow 66 across the relatively large area adjacent the player's right shoulder blade. Similarly, another component of the compressive force applied to collar 12 radiates into chest panel 18. The cross-linked, closed-cell foam described above is particularly advantageous in this regard.

Figure 2:
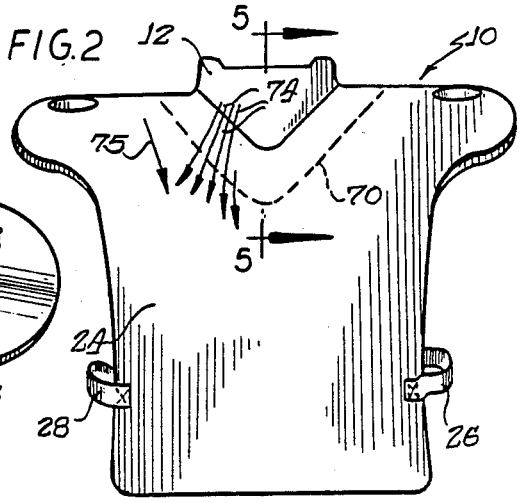
FIG. 2 is a rear view of the protective vest of FIG. 1.

If it is desired to dissipate a greater percentage of the force applied to collar 12 in the back panel 24, the optional collar construction 70 indicated in phantom in FIG. 2 can be employed. Generally, the numeral 70 is applied to a rear collar portion which extends deeper or in a further downward direction into the back portion, generally terminating at a point below a line connecting the player's armpits. According to one aspect of the present invention, the outer edges of optional rear collar portion 70 form an included angle less than 90°. In contrast, the edges of collar 12 shown in solid lines in FIG. 2 form an included angle of approximately 135°. The smaller included angle and extended edges of optional rear collar portion 70 spread the compressive force applied to the top collar surface 40 across a greater portion of back panel 24, as can be seen by the arrows 74, which generally indicate the lines of directed force resulting from contact with a helmet drawn toward the back of a player, generally without a sideways rotation. Since some lines of directed force 74 (see FIG. 2) are not normal to the edge of collar 70 with back panel 24, that force component will tend to be resolved not only by a compression of back panel adjacent collar 70, but also by stretching forces which would tend to dislocate body 16 in the direction of arrow 75, were it not for the supple, resilient construction of body 16. In contrast, the lines of force are generally normal to the edges of collar 12, and these forces will generally be resolved mainly by a compression of back panel 24 adjacent to collar 12.

According to one aspect of the present invention, whether the collar 12 or the collar 70 is used, any pressure applied to the collar is also dissipated in a stretching of the chest panels 18, 20, in a manner which not only reduces the loading of the collar, but also helps to control the distortion thereof, thereby providing continuous control over the action of collar 12, even in times of extreme loading. For example, the dislocation of back panel 24 in the direction of arrow 24 is accompanied by a stretching-type of dislocation 75' in chest panel 20, especially when shoulder pads are worn, which have a greatly reduced coefficient of friction. This is preferred to avoid a concentration of stress on the relatively small area shoulder portion of body 16. Similarly, a lateral extension of the player's head, such as that indicated in phantom in FIG. 4, not only puts that side of the collar and the adjacent chest panel area in compression, but also places the remote chest panel and shoulder portion of body 16 in resilient tension, which further aids in absorbing the applied load.

If desired, the chest and collar portions, as well as the back portion, can be made to have different resilient qualities, to provide a degree of load-absorbing control heretofore unavailable. For example, if less distortion of the collar is desired under heavy loading, the chest panels, particularly the upper portions thereof adjacent the player's collarbone, can be made to stretch more easily, while the collar can be made of slightly less resilient material, so as to more completely transfer the load to the chest and back portions, while still having the resilience needed to absorb some of the force under compression. Further, by adjusting the directional properties of the cross-linked, closed-cell foam material, the protective device 10 can be "tuned" to provide a particular response desired by a player. For example, assuming an upright orientation of the player's torso, the material can be made to stretch more easily in the vertical direction than in a horizontal direction (e.g., across the shoulders) so as to control slightly the preferred direction that a player's head will take when placed under stress. One manner of "tuning" the force-absorbing response of different portions of body 16 is to form the body with cross-linked, closed-cell foam, different portions of which have differing densities. For example, a lesser density in the chest panel areas, and a greater density in the collar and back panels will transfer a greater portion of the load applied by a rearwardly deflected helmet to the chest panel, with lesser amounts of the load being absorbed by compression of the collar and back panels.

The material can also be made to have different responses to compressive forces directed into the plane of the material as well as shear forces directed along the material's surface. For example, if the collar is made to extend lower into back panel 24, as indicated in phantom by the optional collar 70, the loads applied to the back panel have a lesser component which compresses the thickness of the back panel 24 (compared to the shorter collar 12), and a greater (shear) component, extending parallel to or in the plane of back panel 24. The resistance of the material of collar 12 to compression is thereby made greater than the resistance of the back and front panels to shear forces, so as to shift greater portions of the applied load to lower portions of the player's back, more remote from the neck. Conversely, if the compressive resistance of the material of collar 12 is less than its resistance to shear, a greater portion of the force will be locally absorbed, adjacent the upper surface 40 thereof. Thus, device 10, and particularly the back panel 24 thereof, can be placed in different modes of load-bearing energy absorption by altering the configuration of the collar and the relative response of the foam material to compression (thicknesswise) and shear distortion (stretching or compressing in the direction of the foam surface). Other arrangements are, of course, possible. For example, the collar 70, rather than having a generally "V" shaped tip at its lower end, can be reconfigured so as to "fan-out" across the shoulder blades of the player. For example, collar 70 can have a generally "W" pattern with lower protruding portions extending generally in the direction of each shoulder blade.

When formed of an absorbent material, it is important that body 16 not become waterlogged throughout the course of an athletic event due to perspiration from the player's body. In this regard, it is important to provide at least the inner surface of body 16 with a moisture barrier which resists or prevents intrusion of perspiration. Also, when playing in inclement weather, it is desirable to also provide the outer surface of body 16 with a moisture barrier to prevent intrusion from rain, sleet or the like. This is desirable not only since trapped moisture adds to the weight that the player must carry, but it is also possible that the moisture trapped in foam material, for example, would alter the ability of that material to respond quickly to absorb energy when placed under load. For example, a waterlogged foam material exhibits a dampened response which causes a slower reaction than when dry, and also can absorb only lesser amounts of energy, since the cells and air voids of the foam material are filled with relatively incompressible moisture.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A protective device for use with helmets of the type worn by players in contact sports, comprising:

a flexible body of resilient material having shoulder, chest and back portions covering substantial portions of the shoulders, chest and back of a player respectively, and having a raised resilient collar immediately adjacent a central portion of the device defining an opening for the head of a wearer of the device, said raised resilient collar integrally formed with and continuously joined to said chest and said back portions so as to transmit thereto forces applied to an upper surface of said raised collar by the bottom of a helmet worn by the wearer, said body having an inner surface for frictionally engaging the body of a wearer so as to maintain said device in a preselected position about the body of a wearer so that displacement of said raised resilient collar portion is resisted with a resilient bias force which maintains said collar portion in said preselected position about the body of a wearer.

2. The protective device of claim 1 wherein said device is pliable so as to generally conform to the shoulders, chest and back of the wearer and garments in contact therewith, so as to increase the area of frictional engagement therewith when said device is placed under stress.

3. The protective device of claim 2 further comprising joining members joining said chest and back portions, so as to encircle the upper torso of the player with a compressive engagement so as to maintain said device in said preselected position about the body of the wearer.

4. The protective device of claim 3 wherein joining members comprise straps having first ends affixed to said chest portions and second ends affixed to said back portion.

5. The protective device of claim 3 wherein said joining members comprise side panels of resilient foam material intermediate said chest and said back portions.

6. The protective device of claim 1 wherein the chest portion thereof is comprised of two separable parts to provide ready placement about the upper torso of a wearer.

7. The protective device of claim 6 wherein said separable parts of said chest portion include releasable fasteners for releasably joining the separable portions together.

8. The protective device of claim 1 wherein said raised collar is comprised of plural layers of foam material having different compression-resisting resilient forces.

9. The protective device of claim 8 wherein said plural foam layers comprise foam layers of different densities, with a layer of lesser density adjacent the, upper surface of said raised collar.

10. The protective device of claim 1 wherein said raised collar is comprised of a unitary molded construction having differing density portions with a lesser density portion adjacent the upper surface of said raised collar.

11. The protective device of claim 1 further comprising layers of wear-resisting material on the upper surface of said raised collar, protecting said raised collar from wear caused by contact with the bottom of said helmet.

12. The protective device of claim 1 wherein said raised collar forms a generally V-shaped joinder with said back portion, said V-shaped joinder having an included angle not more than 90 degrees.

13. The protective device of claim 1 wherein said raised collar forms a generally V-shaped joinder with said back portion, said V-shaped joinder having an included angle greater than 90 degrees.

* * * * *